US007438250B2

(12) United States Patent
Anderson et al.

(10) Patent No.: US 7,438,250 B2
(45) Date of Patent: Oct. 21, 2008

(54) LOW ENTRY HOSE REEL DEVICE WITH ELEVATED POINT OF OPERATION

(75) Inventors: Torrence Anderson, Overland Park, KS (US); Robert Stein, Aurora, IL (US); Mike Uffner, Naperville, IL (US); Joe Bella, Plainfield, IL (US)

(73) Assignee: Suncast Corporation, Batavia, IL (US)

( * ) Notice: Subject to any disclaimer, the term of this patent is extended or adjusted under 35 U.S.C. 154(b) by 0 days.

(21) Appl. No.: 11/610,002

(22) Filed: Dec. 13, 2006

(65) Prior Publication Data

US 2007/0114319 A1 May 24, 2007

Related U.S. Application Data

(63) Continuation-in-part of application No. 29/243,432, filed on Nov. 23, 2005, and a continuation-in-part of application No. 29/243,433, filed on Nov. 23, 2005, and a continuation-in-part of application No. 29/243,434, filed on Nov. 23, 2005, and a continuation-in-part of application No. 29/243,435, filed on Nov. 23, 2005, and a continuation-in-part of application No. 29/243,426, filed on Nov. 23, 2005, and a continuation-in-part of application No. 29/243,502, filed on Nov. 23, 2005, and a continuation-in-part of application No. 29/243,503, filed on Nov. 23, 2005.

(51) Int. Cl.
*B65H 75/30* (2006.01)

(52) U.S. Cl. ..... 242/395; 242/397.4; 137/355.26

(58) Field of Classification Search ..... 242/397, 242/397.1, 397.2, 397.3, 397.4; 137/355.26, 137/355.27; 254/385
See application file for complete search history.

(56) References Cited

U.S. PATENT DOCUMENTS

| | | | | | |
|---|---|---|---|---|---|
| 1,115,325 | A | | 10/1914 | McCall | |
| 1,433,412 | A | * | 10/1922 | Playle | 242/397.3 |
| 2,301,208 | A | * | 11/1942 | Gear | 242/397.3 |
| 3,876,045 | A | * | 4/1975 | Knarreborg | 242/397.3 |
| 4,220,293 | A | * | 9/1980 | Gename | 242/397 |
| 4,513,772 | A | * | 4/1985 | Fisher | 242/397.3 |
| 4,616,791 | A | * | 10/1986 | Harvey | 242/397.3 |
| RE32,510 | E | | 9/1987 | Tisbo | |
| 4,777,976 | A | * | 10/1988 | Johnston et al. | 242/397.4 |
| 4,947,627 | A | | 8/1990 | Schiedegger | |
| 5,388,609 | A | | 2/1995 | Ghio et al. | |
| 5,404,900 | A | | 4/1995 | Fletchall | |

(Continued)

FOREIGN PATENT DOCUMENTS

| | | | | |
|---|---|---|---|---|
| JP | 6-100247 | * | 4/1994 | 242/397.3 |

*Primary Examiner*—William A Rivera
(74) *Attorney, Agent, or Firm*—McHale & Slavin, P.A.

(57) ABSTRACT

Among the several aspects and features of the present invention may be noted the provision of an improved portable hose reel cart having a low-entry point for recoiling a hose in conjunction with an elevated hand crank for use in rotation of the reel. In an additional embodiment, the elevated hand crank is also used for movement of a level-wind hose guide for positioning of the flexible hose around the hose reel. The present invention also provides an enclosure that includes injection molded panels having integrally formed connectors adapted to cooperate with injection molded as well as extruded panels for assembly of a hose reel enclosure.

20 Claims, 8 Drawing Sheets

U.S. PATENT DOCUMENTS 5,758,685 A * 6/1998 Tisbo et al. ..... 137/355.26
5,998,552 A 12/1999 Gruber et al.
6,050,290 A * 4/2000 Yacobi et al. ..... 242/397.3
6,338,360 B2 * 1/2002 Spear et al. ..... 242/397.3
6,742,740 B2 6/2004 Tisbo
6,908,058 B2 6/2005 Moon et al.
6,913,221 B2 * 7/2005 Moon et al.
6,979,649 B2 12/2005 Aria et al.

* cited by examiner

LOW ENTRY HOSE REEL DEVICE WITH ELEVATED POINT OF OPERATION

RELATED APPLICATIONS

This application is a continuation in part of Ser. No. 29/243,432 filed Nov. 23, 2005 entitled Bottom Feeding Hose Reel Enclosure with Wheels and a See Through Cover, Ser. No. 29/243,433 filed Nov. 23, 2005 entitled Bottom Feeding Hose Reel Enclosure With Wheels and Opaque Cover, Ser. No. 29/243,434 filed Nov. 23, 2005 entitled Bottom Feeding Hose Reel Enclosure with See-Through Cover, Ser. No. 29/243,435 filed Nov. 23, 2005 entitled Bottom Feeding Hose Reel Enclosure, Ser. No. 29/243,426 filed Nov. 23, 2005 entitled Ornamental Shape for a Hose Reel Enclosure with Wheels, Ser. No. 29/243,502 filed Nov. 23, 2005 entitled Ornamental Shape for a Hose Reel Enclosure with See-Through Cover, Ser. No. 29/243,503 filed Nov. 23, 2005 entitled Ornamental Shape for a Bottom Feeding Hose Reel Enclosure, the contents of which are incorporated herein by reference.

FIELD OF THE INVENTION

This invention relates generally to garden tools, and more specifically to a hose reel device having an entry point below the centerline of the reel for stability of the enclosure and a crank operation point at or above the centerline of the reel for ease of operation.

BACKGROUND OF THE INVENTION

Portable hose reel carts for handling and storage of flexible water hoses, such as garden and air hoses, have gained wide public acceptance. While the construction of hose reel carts is quite varied, such carts are primarily constructed of molded plastic components having a centrally disposed rotatable spool for reeling of the flexible hose, a frame for supporting of the spool, wheels may be included at one end of the base of the frame, and a frame handle for tilting the frame onto the wheels to facilitate moving the cart. The frame handle may, or may not be foldable or telescoping for purposes of shipping and/or storage. For more information concerning the structure and operation of hose reel carts, reference may be made to U.S. Pat. RE. 32,510, and U.S. Pat. No. 5,998,552 the teachings of which are hereby incorporated by reference.

Common to hose reel carts is the use of a crank handle secured to a hub for use in rotation of a spool. The spools are typically arranged with the crank handle located at the center of the hub to wind the flexible hose. Attempts have been made to move the location of the crank handle, however, such attempts typically employ the use of a sprocket and chain assembly leaving little in the way of efficiency, ratio gearing, or the ability to compactly store such a device. The advantage of an elevated crank handle is to allow rotation of the spool by an operator who need not bend over to perform the operation. Standing upright lessens the strain on an individual's back, but typically crank movement does not address the change in location for gearing leverage, or address storage of such a device.

For instance, U.S. Pat. No. 1,115,325 discloses a garden hose reel storage device wherein the spool is rotated from a crank mounted a distance above the spool. The remotely mounted crank is coupled by a chain extending between a pair of sprockets for driving the spool. A smaller sprocket secured to the crank provides a gear reduction to the larger sprocket adjacent to the spool. The direct coupling requires a large diameter spool sprocket that is difficult to shield and creates dangerous pinch points.

U.S. Pat. No. 5,388,609 discloses a hose reel cart having a remotely mounted crank handle coupled to a spool by a chain and sprocket assembly. This disclosure utilizes an oversize crank handle thereby reducing the size of sprockets needed to transfer rotation from the hand crank to the hose reel spool.

U.S. Pat. No. 4,947,627 discloses a hose reel cart employing yet another sprocket and chain drive assembly. In this disclosure a crank sprocket is mounted along a side wall of the cart, at a slightly elevated position. The hand crank remains well below the cart handle. Thus, the device fails to take advantage of the highest point on the cart and continues to force the operator to crank the spool from a lower position.

U.S. Pat. Nos. 6,742,740, 6,908,058 and 6,976,649, assigned to same assignee as the instant invention, disclose hose carts with elevated cranking positions. These devices all utilize various combinations of intermeshing gears to transmit power between the crank, the reel and/or the level-wind device. However, one shortcoming with these devices is the elevated point from which the hose is recoiled onto the reel. The elevated recoil position may increase the likelihood of overturning the device during hose rewinding.

U.S. Pat. No. 5,404,900, assigned to the same assignee as the instant invention, discloses a hose enclosure with a level-wind apparatus for distributing the hose in an even manner across the face of a reel.

Thus, what is lacking in the art is a hose reel device having an elevated crank handle and a low-entry area for recoiling the hose. Also what is lacking in the art is a hose reel enclosure that includes a combination of injection molded and extruded panels for a low-cost yet robust enclosure. Prior art assemblies that utilize extruded panels require separate connectors to attach the panels together, increasing the number of components and connections required to assemble an enclosure, thereby increasing the complexity an cost of assembly. The hose reel device should include intermeshing gear drives for transfer of motion from the crank to the reel and/or level-wind components.

SUMMARY OF THE INVENTION

Among the several aspects and features of the present invention may be noted the provision of an improved portable hose reel cart having a low-entry point for recoiling a hose and an elevated hand crank for use in rotation of the reel spool. In an additional embodiment, the elevated hand crank is also used for movement of a level-wind hose guide for positioning of the flexible hose around the hose reel spool.

The hose reel cart of the present invention is of a shape and design so that the hose reel cart may be preassembled at the factory, thereby eliminating the need for assembly and associated product packaging. Preassembly of the hose reel cart permits the use of an enclosed construction for support of a hose to be wound into a coil of multiple layers with adjacent turns of each layer touching each other by use of a directional spool rotatably coupled to the enclosure. The hose is wound around the spool by use of a remotely located crank providing an direct or indirect rotational link between the crank and the winding of the spool. In the preferred embodiment, the crank is positioned in an upper portion of the enclosure assembly to allow for operation of the device with minimal bending or stooping. A hand-grip on the crank can also be placed in a storage position by pivoting the hand-grip about one end of the crank arm. The hand-grip has a releasable lock for securing the hand-grip in a parallel position with the crank arm for storage, and securing the crank hand-grip in a perpendicular position with respect to the crank arm for operation. In addition to providing the appropriate spacing, the intermeshing gears connect the crank to the reel and the optional level-wind components.

The instant invention utilizes a combination of injection molded and extruded panels to create a low-cost yet robust enclosure. Combining injection molded panels with extruded panels facilitates reducing the number of components required to assemble an enclosure when compared to enclosures comprised entirely of extruded panels. Injection molding facilitates integral formation of various connectors about the panel. The integrally formed connectors facilitate connecting the injection molded panel to extruded panels, blow molded panels and injection molded panels, eliminating the separate connectors required by the prior art devices.

Thus, an objective of the instant invention is to provide a portable hose reel enclosure having an elevated crank handle and a low-point of entry for retraction of a hose.

Another objective of the instant invention is to disclose a hose reel enclosure that includes injection molded as well as extruded panels to provide a lightweight yet robust enclosure assembly.

Yet another objective of the invention is to provide a portable hose reel cart having an elevated crank handle that can position a hose guide in addition to providing rotation to the hose reel hub.

Still another objective of the instant invention is to teach a combination of injection molded and extruded panels wherein connectors are integrally formed onto the edges of injection molded panels for connection to extruded and/or blow molded panels.

Still yet another objective of the instant invention is to provide an enclosure assembly which reduces the number of components required to assemble an enclosure to simplify construction.

A further objective of the instant invention is to provide a hose reel enclosure having a structural lid member having a lid strap for lid retention.

Other objectives and advantages of this invention will become apparent from the following description taken in conjunction with the accompanying drawings wherein are set forth, by way of illustration and example, certain embodiments of this invention. The drawings constitute a part of the specification and include exemplary embodiments of the present invention and illustrate various objectives and features thereof.

DETAILED DESCRIPTION OF THE INVENTION

Figure 1:
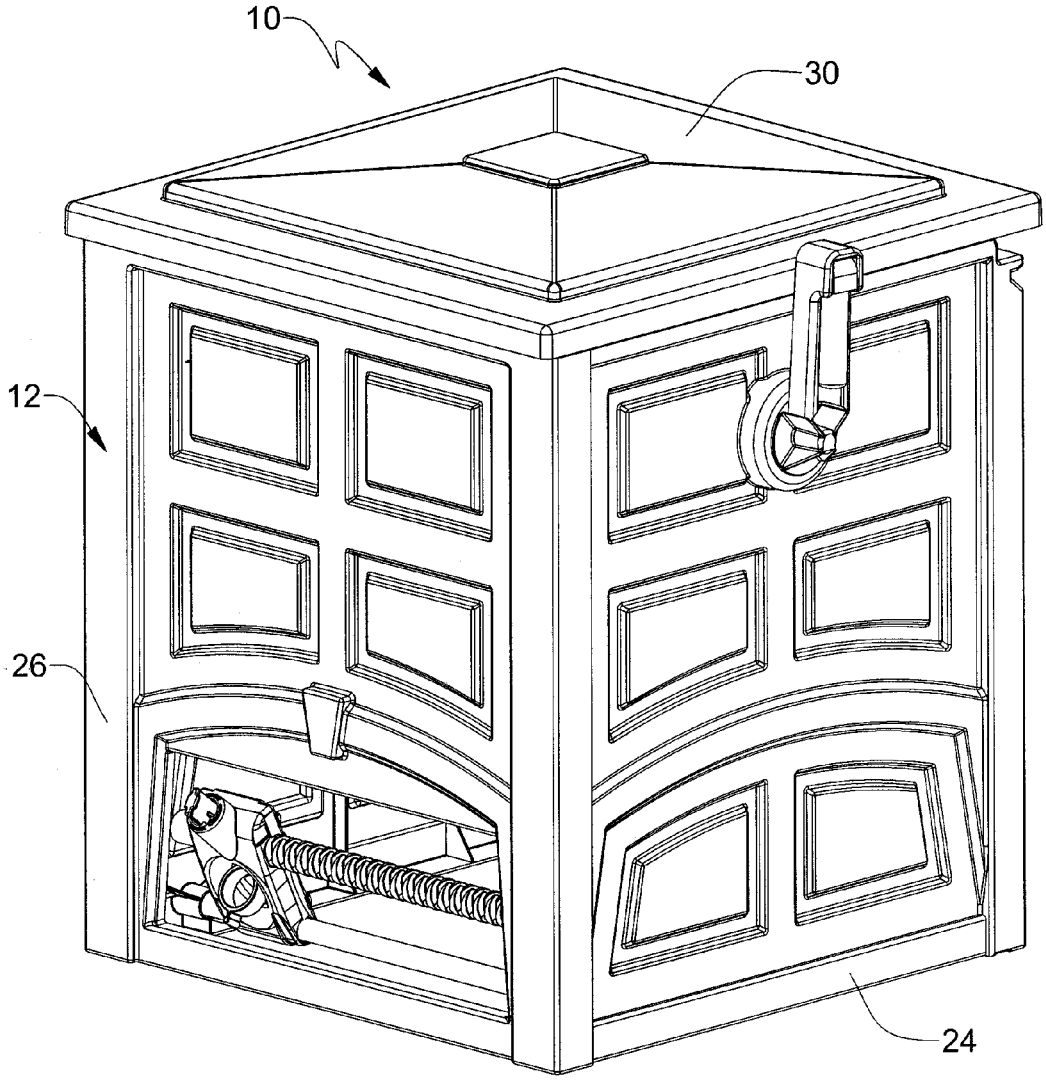
FIG. 1 is a front perspective view illustrating a hose reel apparatus constructed with the teachings of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Referring generally to the Figures, a hose reel apparatus 10 having an elevated point of operation and a low-entry point for hose retrieval is illustrated. The hose reel apparatus of the preferred embodiment includes an enclosure assembly 12, a spool assembly 14, a level-wind assembly 16, a first gear train 18, a second gear train 20, and a crank assembly 22.

The enclosure assembly includes a pair of side panels 24 secured in a substantially parallel arrangement. A front panel 26 extends between the side panels 24 at a front portion thereof to enclose the front portion of the enclosure and a rear panel 28 extends between the side panels at a rear portion thereof to enclose the rear portion of the enclosure. A lid member 30 encloses the top portion of the enclosure. In the preferred embodiment, the side members, front panel and lid member are formed by the process of injection molding to include integral connectors, ribs 46 and gussets 48. The side panels 24 include integrally formed first connectors 32 along one edge thereof and integrally formed second connectors 34 along a second opposite edge thereof. The first connectors 32 are illustrated herein as at least one outwardly extending locking post 34 being constructed and arranged to cooperate in an interlocking manner with at least one inwardly extending socket 36 positioned along the edges of the front panel for interlocking cooperation therebetween. The locking posts 34 are constructed and arranged to cooperate with the front panel for connecting and maintaining a substantially perpendicular relationship between the front and side panel members. It should also be noted that while the locking posts are illustrated as being rectangular in shape when viewed from the end, other shapes suitable for locating and securing panels together may be utilized without departing from the scope of the invention. In a most preferred embodiment, each locking post 34 includes at least one detent or spring lock fastener 38 integrally formed thereto. The spring lock is constructed and arranged to cooperate with a catch surface 40 positioned within each socket for snap-together interlocking engagement. Those skilled in the art will appreciate that the snap-type fasteners 38 can be used throughout the hose reel device 10 to mount or secure components to one another, and to facilitate ready assembly of the cart if it is provided in an unassembled manner.

Figure 2:
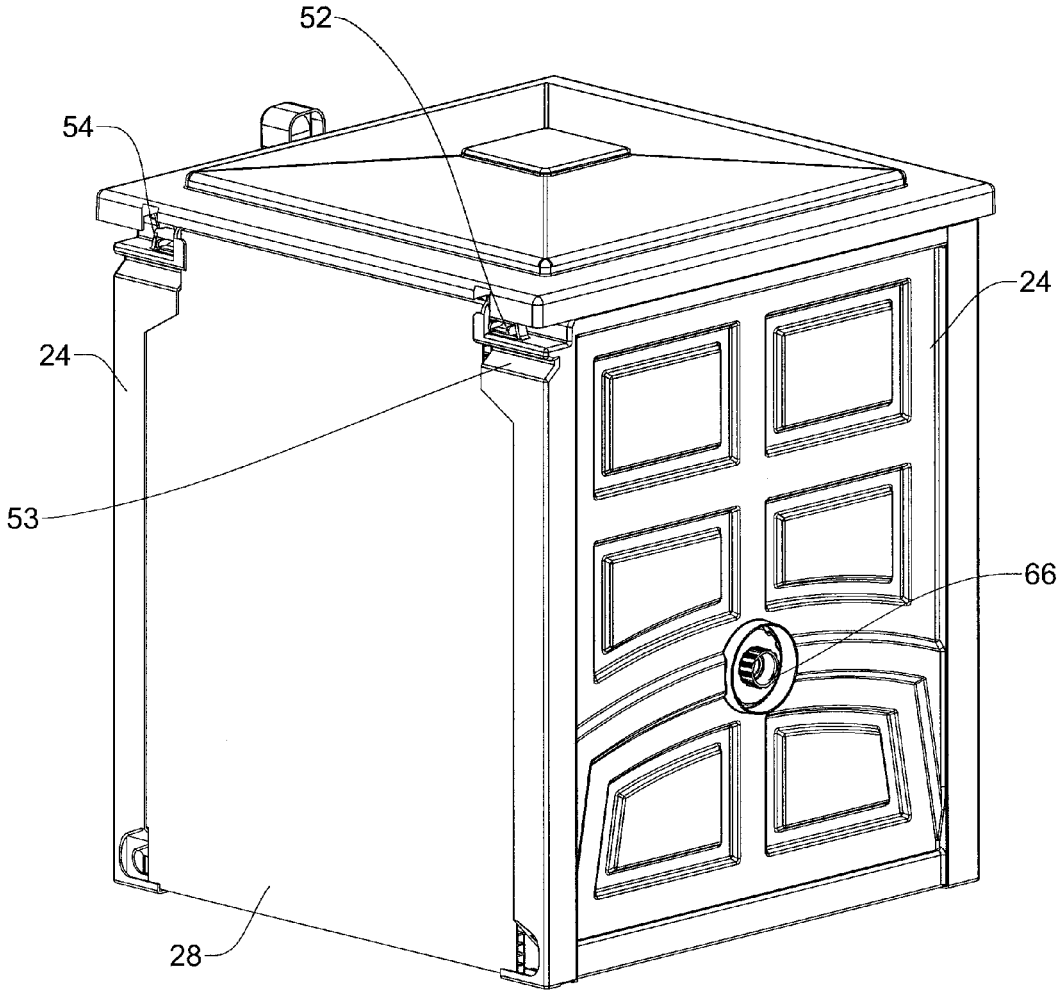
FIG. 2 is a rear perspective view illustrating a hose reel apparatus constructed with the teachings of the present invention.
Figure 4:
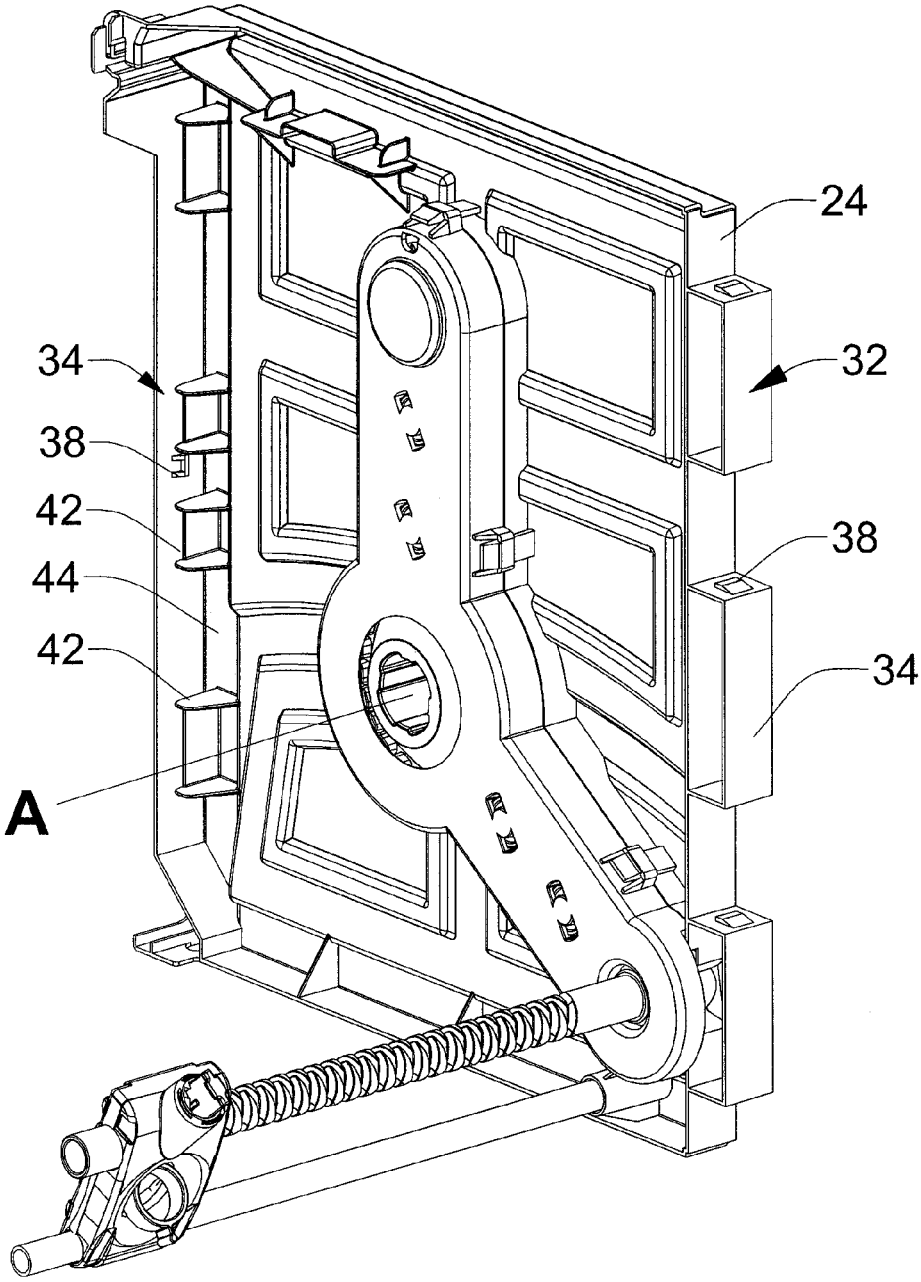
FIG. 4 is a partial perspective view illustrating a gearbox and a level-wind assembly constructed with the teachings of the present invention.
Figure 5:
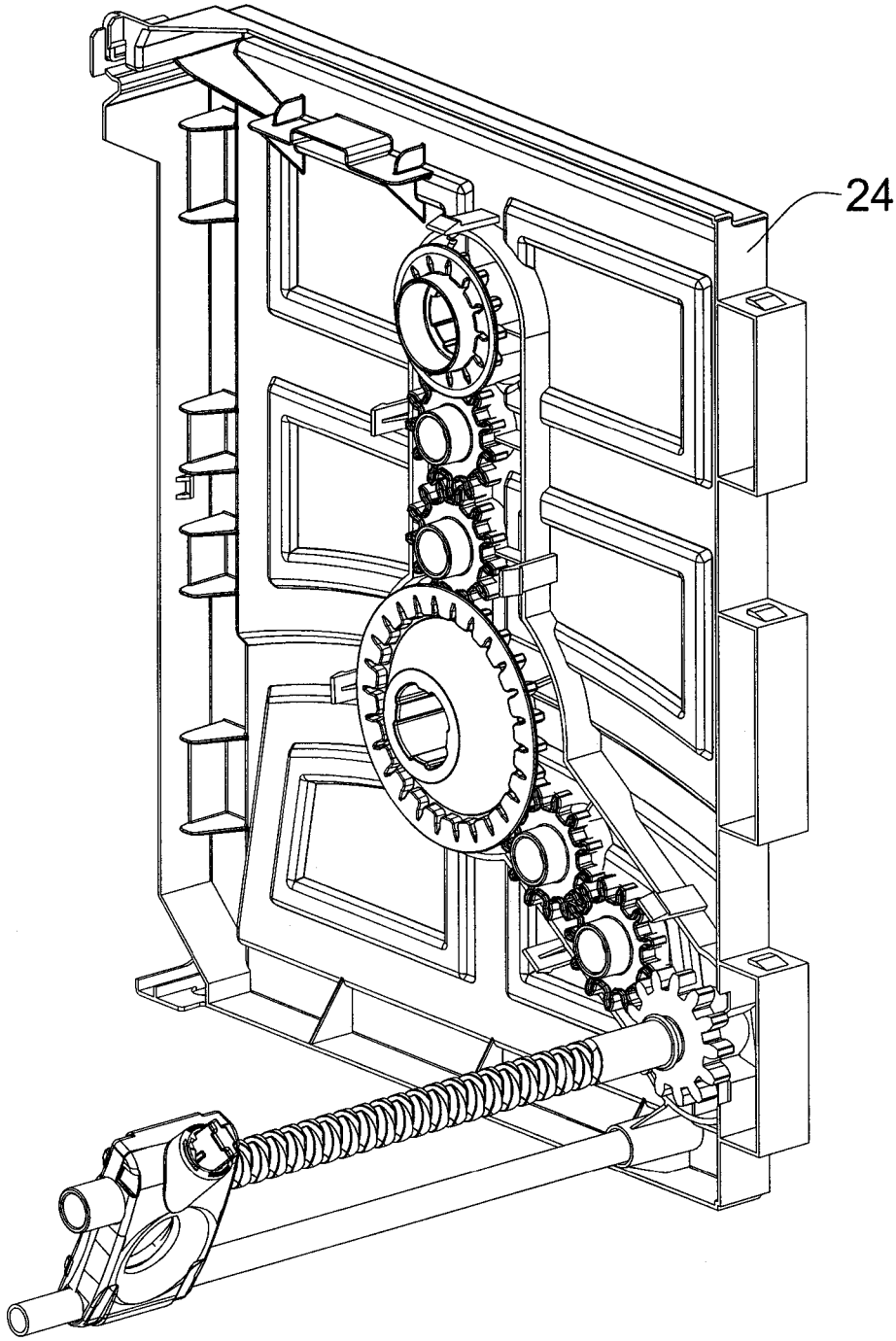
FIG. 5 is a partial perspective view illustrating a gear-train constructed with the teachings of the present invention.

Referring to FIGS. 2 and 4, the second connectors 34 are illustrated herein as two spaced apart substantially parallel surfaces 42 extending outwardly from an end surface 44 forming a U-shape for connection to an adjacently positioned extruded or blow molded rear panel 28. In a most preferred embodiment, at least one of the parallel surfaces include a spring lock fastener integrally formed thereto for cooperation with a catch surface positioned in the rear panel.

It should be noted that while the locking posts are illustrated as formed on the edges of the side panels, the locking bosses may be formed on the edges of the front or rear panel and the sockets formed into the side panels without departing from the scope of the invention.

Figure 3:
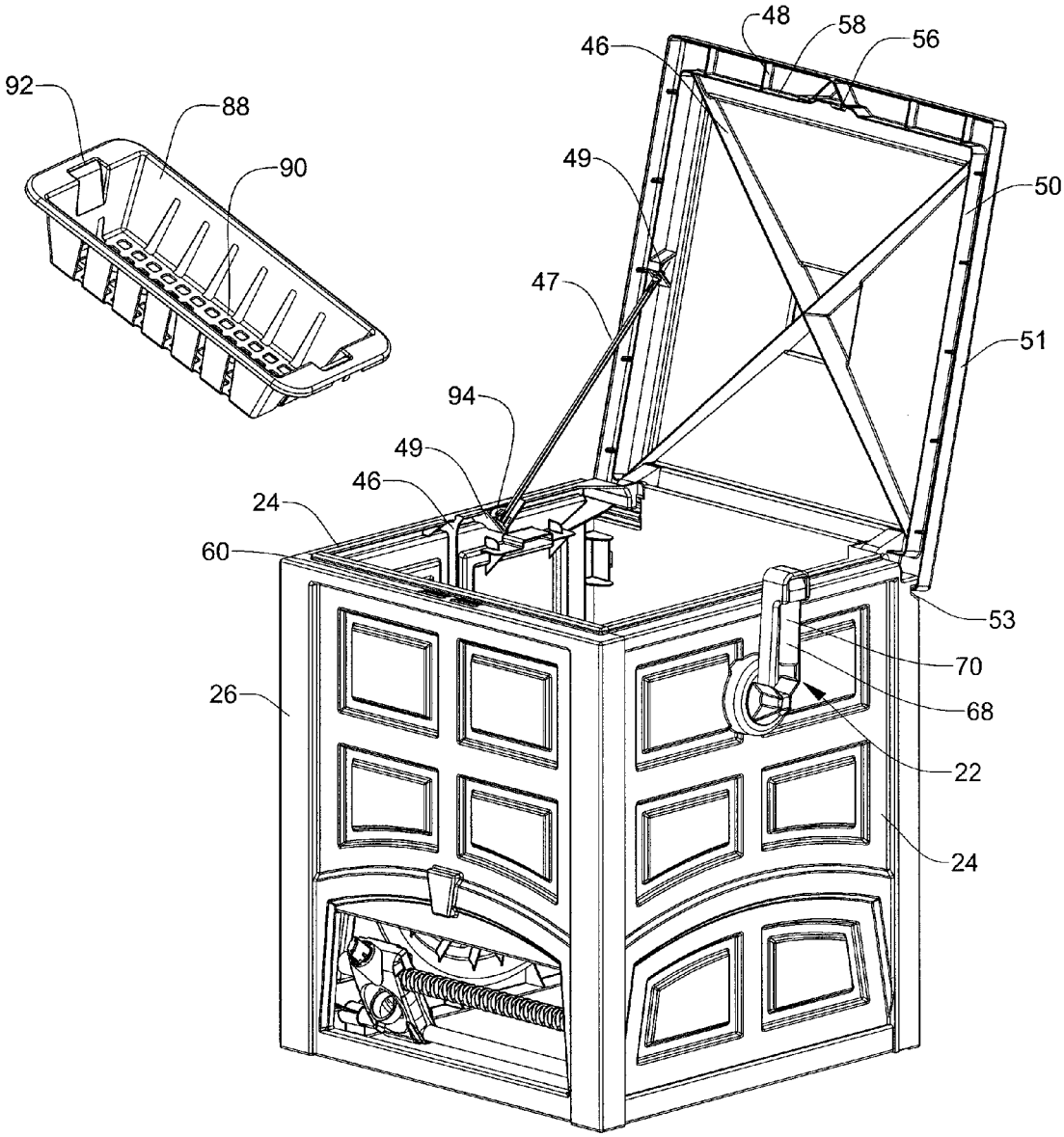
FIG. 3 is a front perspective view illustrating a the lid member of the enclosure in an open position.

Referring to FIGS. 1-3, the lid member is illustrated. The lid member includes a bottom surface 50 constructed and arranged to cooperate with the front panel, the rear panel and the side wall members in a closed position to maintain a weather-tight enclosure. The bottom surface 50 illustrates the ribs 46 and gussets 48 facilitated by injection molding of panels. In addition to the strengthening ribs 46, the bottom surface of the lid member includes a depending lip 51 extending around the perimeter of the lid and a hinge means integrally formed to a rear portion thereof. The hinge means is illustrated herein as a pair of depending C-shaped members 52 and loop shaped receivers 54. A latch means 56 is integrally formed to a front portion of the lid member for releasably securing the cover to the front panel. The latch means is illustrated herein as a depending spring-lock 58 that is constructed and arranged to cooperate with apertures 60 positioned in the upper edge of the front panel. It should be noted that other latch means well known in the art may be utilized without departing from the scope of the invention. In operation, when the lid is opened a portion of the depending lip 51 pivots to engage an inwardly extending recess 53. The engagement between the depending lip 51 and the recess 53 control the rotation of the lid and prevent the lid prevent from being removed from the enclosure. Strap 47 may also be provided to control rotation of the lid and further tie the lid to the enclosure. Integrally formed mounts 49 allow the ends of the strap 47 to be snapped into engagement with the lid and the side panel.

Injection molding of the panel members offers significant strength, stability and versatility advantages over blow-molding, extrusion or vacuum molding as utilized in the prior art. Injection molding facilitates forming thicker and/or thinner portions within the same panel for areas of high or low stress concentrations such as is required with the first and second connectors to facilitate connection to panels manufactured by different methods. It should also be appreciated that the injection molded panels of the instant invention only require a single wall construction, while the extruded or blow molded panels may include two or more walls integrally connected together. It should also be noted that while only the rear panel is illustrated as being an extruded panel, the first and second connectors may be formed along the edges of any injection molded panel, used in construction of the enclosure, for cooperation with an adjacently positioned extruded or blow molded panel. In this manner, an enclosure comprising various combinations of extruded, injection molded and blow molded panels may be constructed for economy, strength and durability.

Figure 8:
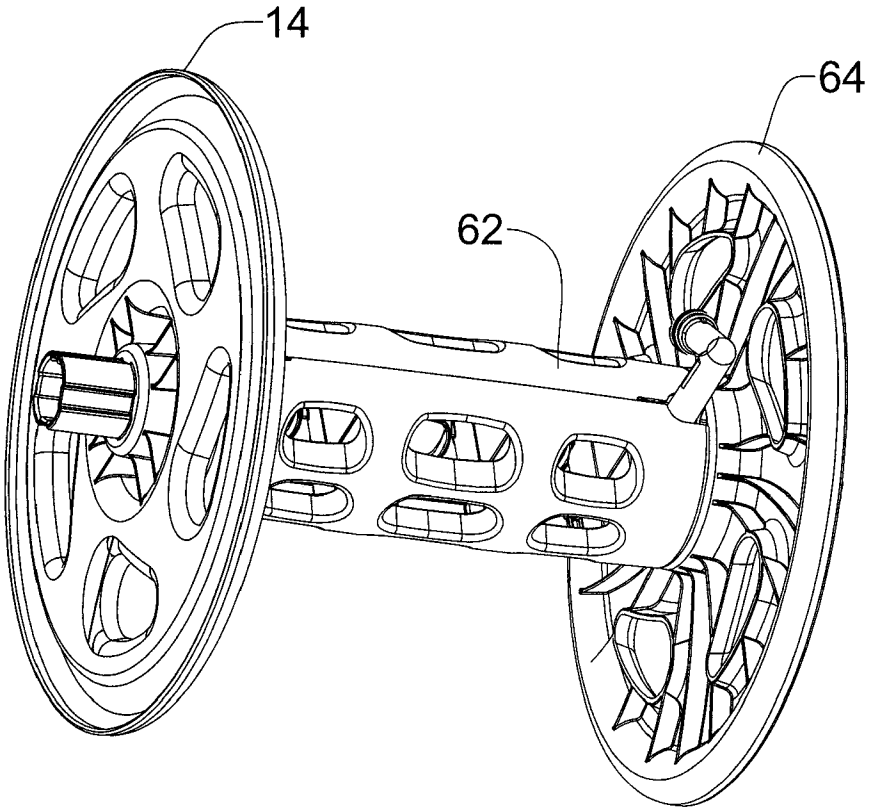
FIG. 8 is a perspective view of one embodiment of a reel suitable for use in the instant invention.

Referring to FIG. 8, a rotatable reel assembly suitable for use with the teachings of the instant invention is illustrated. The rotatable reel assembly 14 is operably connected between the side panels 24 for rotation about an axis of rotation A (FIG. 4). The rotatable reel 14 provides for pick-up, storage and pay-out of an elongated hose member. The spool 14 includes a central hub 62 and a pair of radially extending flanges 64 that are configured to accommodate a length of flexible hose wrapped around the hub 62 between the flanges 64. In a typical arrangement, the hose reel apparatus 10 may store between 50 to 300 feet of a ⅝ inch common hose. Those skilled in the art will recognize that the hose reel apparatus 10 may include a water/air inlet port or in-tube 66 (FIG. 2) and an outlet port or out-tube (not shown). Typically the in-tube is mounted to the side panel 24 at about the axis of rotation A of the spool 14. The in-tube is connected to the out-tube by a sliding seal arrangement (not shown) so that the in-tube remains fixed to the side panel 24, while the out-tube rotates with the spool 14, and the in-tube and out-tube remain in fluid communication with one another. This arrangement permits rotation of the spool 14 without twisting or torquing internal components, while maintaining sealed fluid communication between the water/air supply and the hose. The preferred in-tube and coupling arrangement can be viewed in U.S. Pat. No. 5,998,552, the contents of which are incorporated herein by reference.

Figure 6:
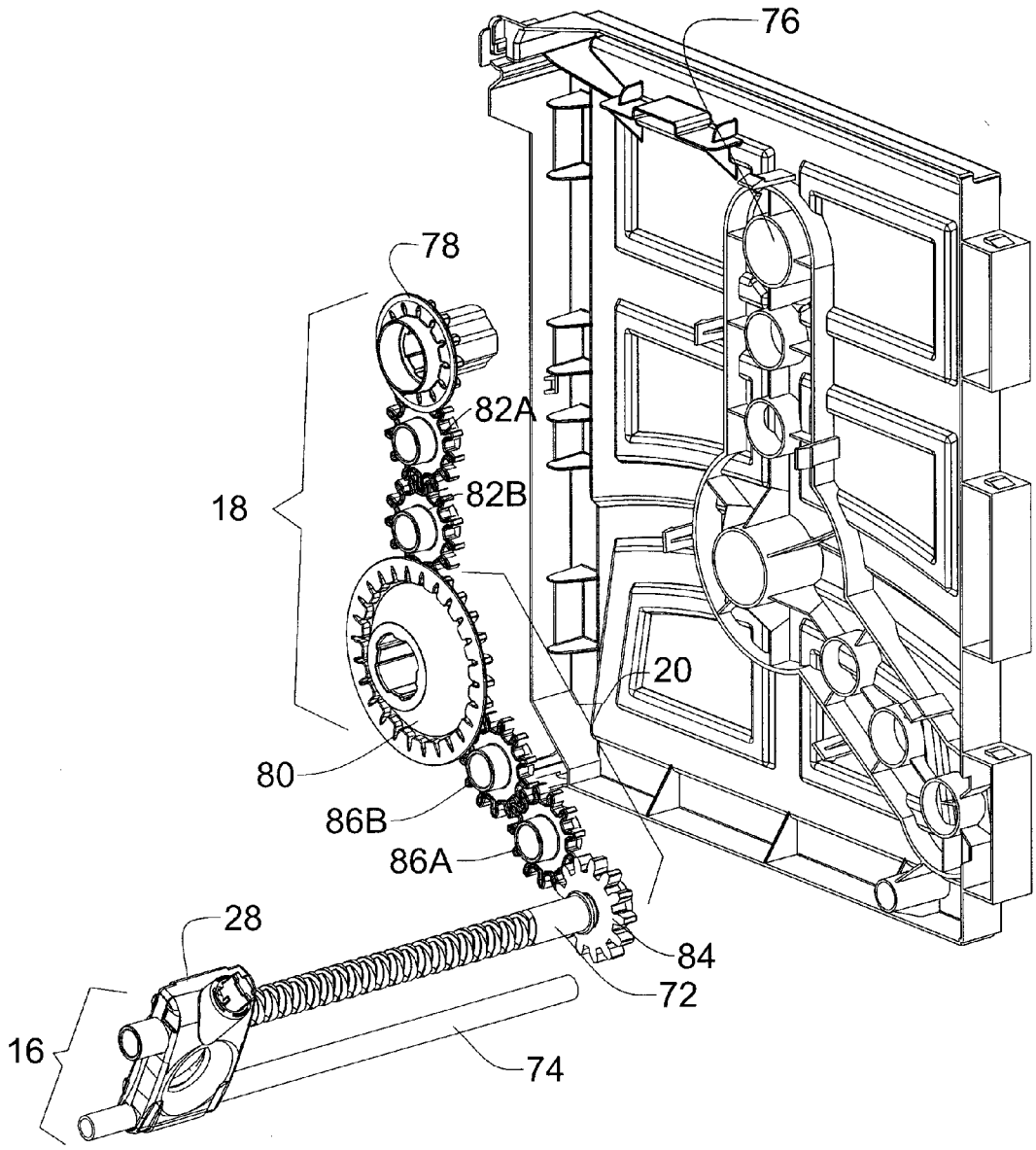
FIG. 6 is an exploded perspective view illustrating integrally formed bearing surfaces constructed with the teachings of the present invention.
Figure 7:
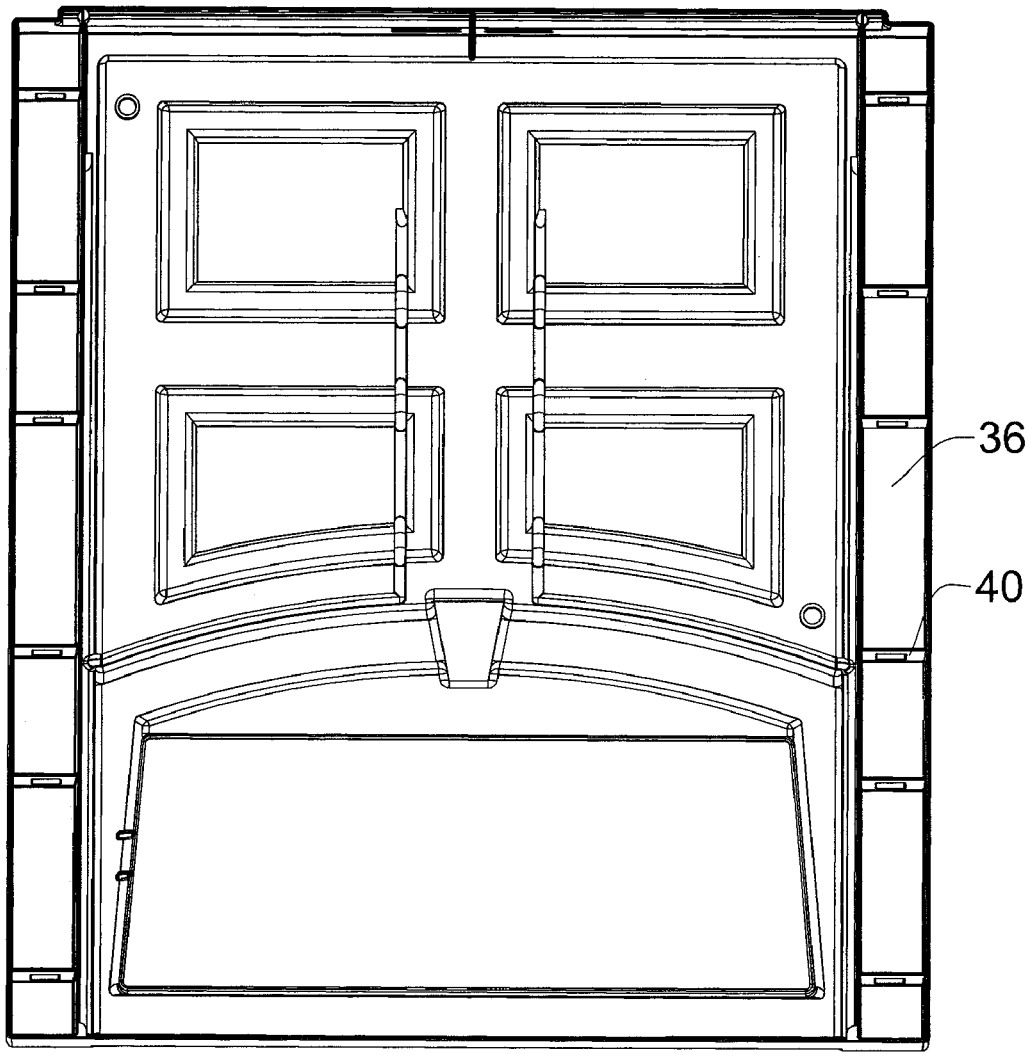
FIG. 7 is a rear perspective view of the front panel constructed with the teachings of the instant invention.

Referring to FIGS. 1, 3 and 6, the crank assembly 22 is rotatably supported and journaled to one of the side wall members 24 at a position above the axis of rotation A to elevate the point of operation for the device. In an alternative embodiment, the crank assembly 22 is rotatably supported and journaled to one of the side wall members 24 at the axis of rotation A. In this manner, the crank could be directly connected to the reel as is well known in the art.

The crank assembly preferably includes a foldable handle 68 for a compact storage and shipping configuration. The foldable handle may include a sleeve 70 that is constructed and arranged to rotate about the handle during operation of the crank. In the preferred embodiment the crank 22 is indirectly connected to the spool assembly via a first gear train 18 to provide rotation thereto. A level-wind assembly 16 is optionally located between the side wall members 24 at a position below the axis of rotation A. The level-wind assembly is operably connected to said spool assembly via a second gear train 20 so that rotation of the spool assembly provides reciprocating movement to a hose guide 28 to uniformly and smoothly wrap a hose onto the spool assembly 14 to provide a compact storage configuration. It should also be noted that the device may be utilized without the level-wind or with a manually operated level-wind (not shown) without departing from the scope of the invention. In a preferred embodiment, the level-wind assembly 16 is automatically reciprocated with the reel. The automatic level-wind assembly 16 includes a double-helix lead screw 72 suitably supported and journaled in the side panels 24 for rotational movement and a single guide element 74 extends between the side panels. It should be noted that while a rod is illustrated as the guide element, other structures such as rails, cables, grooves and the like may be utilized without departing from the scope of the invention. When the spool 14 is rotated the second gear train 20 illustrated in FIG. 6, transfers rotary motion from the spool 14 to the double-helix lead screw 72. A guide 28 cooperates with the double-helix lead screw 72 and slides along the guide element 74 to cause the guide 28 to reciprocate back and forth across the spool 14 facilitating even distribution of the flexible elongate member onto the spool.

Still referring to FIG. 6, in order to provide manual rotation of the hose reel 14 and reciprocation of the automatic level-wind assembly 16, a first gear train 18 is positioned within one of the side panels 24. The crank assembly 22 (FIG. 3) includes an input shaft (not shown) extending inwardly through an opening 76 in an upper portion of the side panel 24 and rotatable with respect thereto. The input shaft is secured to the input gear 78 of the first gear train 18 at a position at or above the axis of rotation A. The spool gear 80 is suitably secured to the spool 14 so as to be rotatable therewith. Idler gears 82A and 82B are positioned within the side panel 24 to be freely rotating with respect to the side panel and directly meshed with the input gear 78, one another, and the spool gear 80 to provide gear powering therebetween. Thus, rotational movement of the input gear 78 with handle assembly 22 will cause similar rotational movement of the spool gear 80 and spool 14. Preferably the spool gear 80 will be larger in pitch diameter than the pitch diameter of the input gear 78 thereby achieving a torque increasing gear reduction desired by the present invention. It should be noted that while the crank is illustrated herein as connecting to the reel at a position above the axis of rotation, the crank may be directly coupled to the reel or any number of idler gears may be utilized for spacing to place the crank above the axis of rotation without departing from the scope of the invention.

Still referring to FIG. 6, the second gear-train 20 utilizes rotation of the spool 14 to cause rotation of the double-helix lead screw 72. The lead screw gear 84 is suitably secured to the lead screw 72 to be rotatable therewith. Idler gears 86A and 86B are positioned within the side panel 24 to be freely rotating with respect to the side panel 24 and directly meshed with the spool gear 80, one another, and the lead screw gear 84 to provide direct gear powering therebetween. Thus, rotational movement of the spool gear 80 will cause similar rotational movement of the lead screw gear 84 and reciprocation of the hose guide 28. Preferably the spool gear 80 will be larger than the lead screw gear 84 thereby achieving the desired amount of hose guide 28 travel per spool 14 revolution for a compact hose storage configuration. It should be noted that while the level-wind assembly is illustrated herein as positioned at a lowermost position within the enclosure, the level wind assembly may utilize more or less idler gears for spacing to position the level-wind at any position at or below the axis of rotation without departing from the scope of the invention.

Referring now to FIG. 3, the enclosure includes a pair of spaced apart side members 24 and may include a storage bin 88 that extends between the side panels. The storage bin is preferably formed as a single piece having multiple living hinges 90 which facilitate assembly. A pair of tabs 92 extend outwardly from the sides of the storage bin to facilitate connection to storage bin receivers 94 which are preferably integrally formed to the inner surface of the side members 24. Alternatively, the storage bin may be formed of multiple components that are glued or suitably fastened together and attached to the inner surface of the enclosure panels as is known in the art. The storage bin 88 can be used to store various hose attachments, such as, spray heads, nozzles and the like. Consumers will recognize the advantage to having the handy storage bin 88 mounted within the enclosure assembly, so that hose attachments can be readily stored with the hose and easily accessed, rather than stored in another location and possibly misplaced or lost.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A hose reel apparatus having an elevated point of operation and a low-entry point for hose retrieval comprising:

at least two side wall members secured in a substantially parallel arrangement;

a rotatable spool assembly located between said side wall members, said spool assembly operably connected to said at least two side wall members for rotation of said spool about an axis of rotation;

a crank member rotatably secured to one of said side wall members above said axis of rotation, said crank member is operably connected to said spool assembly via a first gear train to provide rotation thereto;

a level-wind assembly located between said side wall members at a position below said axis of rotation, said level-wind assembly operably connected to said spool assembly, via a second gear train, so that rotation of said spool assembly provides reciprocating movement to a hose guide to uniformly and smoothly wrap a hose onto said spool assembly to provide a compact storage configuration.

2. The hose reel apparatus of claim 1 wherein said first gear train includes an input gear secured to a crank member input shaft and a spool gear coupled to said spool assembly to be rotatable therewith and being positioned in engagement with respect to said input gear to be rotatable responsive to rotation thereof.

3. The hose reel apparatus of claim 2 wherein said spool gear is larger in diameter than said input gear to cause said spool gear to rotate at a rotational speed less than the rotational speed of said input gear.

4. The hose reel apparatus of claim 2 including at least one idler gear rotatably secured within said one of said at least two side wall members, said at least one idler gear being positioned in engagement with respect to said input gear to be rotatably responsive to rotation thereof, said spool gear being positioned in engagement with respect to said at least one idler gear to be rotatably responsive to rotation thereof, whereby said at least one idler gear provides suitable spacing for securing said crank member above said axis of rotation.

5. The hose reel apparatus of claim 2 including two or more idler gears rotatably secured within said one of said at least two side wall members, said two or more idler gears being positioned in engagement with respect to said input gear and each other to be rotatably responsive to rotation of said input gear, said spool gear being positioned in engagement with respect to at least one of said two or more idler gears to be rotatably responsive to rotation thereof, whereby said two or more idler gears provide suitable spacing for securing said crank member above said axis of rotation.

6. The hose reel apparatus of claim 1 wherein said second gear train includes a spool gear coupled to said spool assembly to be rotatable therewith and a lead screw gear secured to a double helix screw member, said output gear being positioned in engagement with respect to said spool gear to be rotatably responsive to rotation thereof.

7. The hose reel apparatus of claim 6 including at least one idler gear rotatably secured within said one of said at least two side wall members, said at least one idler gear being positioned in engagement with respect to said spool gear to be rotatably responsive to rotation thereof, said output gear being positioned in engagement with respect to said at least one idler gear to be rotatably responsive to rotation thereof, whereby said at least one idler gear provides suitable spacing for securing said level-wind assembly below said axis of rotation.

8. The hose reel apparatus of claim 6 including two or more idler gears rotatably secured within said one of said at least two side wall members, said two or more idler gears being positioned in engagement with respect to said spool gear and each other to be rotatably responsive to rotation of said spool gear, said output gear being positioned in engagement with respect to at least one of said two or more idler gears to be rotatably responsive to rotation thereof, whereby said two or more idler gears provide suitable spacing for securing said crank member below said axis of rotation.

9. The hose reel apparatus of claim 1, wherein said enclosure includes a front panel and a rear panel, wherein said front panel is secured between said side panels at a front portion thereof and wherein said rear panel is secured between said side panels at rear portion thereof, wherein said panels are connected to extend around said spool and said level-wind assembly to define an enclosure, said front panel including an aperture extending across a lower portion thereof for traversal of a hose member.

10. The hose reel apparatus of claim 9, wherein enclosure includes a structural lid member constructed and arranged to cooperate with said panel members to enclose an upper portion of said enclosure.

11. The hose reel apparatus of claim 10 wherein at least two of said panels are formed by injection molding to include integrally formed first connectors along one edge thereof and integrally formed second connectors along a second opposite edge thereof, wherein said first connectors are constructed and arranged to connect with an adjacently positioned injection molded panel in an interlocking manner and wherein said second connectors are constructed and arranged to connect to an adjacently positioned extruded panel.

12. The hose reel apparatus of claim 11 wherein said first connector includes at least one outwardly extending locking post, said at least one locking post being constructed and arranged to cooperate with at least one inwardly extending socket positioned along an edge of said adjacently positioned panel for interlocking cooperation therebetween.

13. The hose reel apparatus of claim 12 wherein said at least one outwardly extending locking post includes at least one spring lock integrally formed thereto, said spring lock constructed and arranged to cooperate with a catch surface positioned within said at least one socket for interlocking engagement therewith.

14. The hose reel apparatus of claim 11 wherein said second connector includes at least two spaced apart substantially parallel surfaces extending outwardly from an end surface, said at least two surfaces spaced sufficiently apart to accept an edge of an extruded panel.

15. The hose reel apparatus of claim 14 wherein said at least one of said substantially parallel surfaces include at least one spring lock integrally formed thereto, said spring lock constructed and arranged to cooperate with a catch surface positioned on said extruded panel.

16. The hose reel apparatus of claim 10 wherein said lid member is hingedly secured to said enclosure, whereby access is provided to the interior of said hose reel apparatus.

17. The hose reel apparatus of claim 16 wherein said lid member includes a bottom surface constructed and arranged to cooperate with said front panel, said rear panel and said side wall members, said bottom surface including a hinge means integrally formed to a rear portion thereof and a latch means integrally formed to a front portion thereof, said latch means constructed and arranged for releasably securing said cover to said front panel, said hinge means constructed and arranged for pivotable securement of said lid member to said side members.

18. The hose reel apparatus of claim 17 wherein said hinge means includes at least one hinge pin receiver for receiving a C-shaped hinge member, wherein said hinge pin receiver and said C-shaped hinge member are constructed and arranged for removal and installation of said lid member while said lid member is located in an open position and wherein said lid member is secure and non-removable when in a closed position.

19. The hose reel apparatus of claim 17 wherein said latch means includes at least one spring lock depending from said bottom surface of said lid member, said spring lock constructed and arranged to cooperate with an aperture positioned in an upper portion of said front panel for releasably securing said lid member in a closed position.

20. A hose reel apparatus having a low-entry point for hose retrieval comprising:

at least two side wall members secured in a substantially parallel arrangement;

a rotatable spool assembly located between said side wall members, said spool assembly operably connected to said at least two side wall members for rotation of said spool about an axis of rotation;

a crank member rotatably secured to one of said side wall members at said axis of rotation, said crank member operably connected to said spool assembly via a first gear train to provide rotation thereto;

a level-wind assembly located between said side wall members at a position below said axis of rotation, said level-wind assembly operably connected to said spool assembly, via a second gear train, said second gear train includes a spool gear coupled to said spool assembly to be rotatable therewith and a lead screw gear secured to a double helix screw member, said output gear being positioned in engagement with respect to said spool gear to be rotatably responsive to rotation thereof so that rotation of said spool assembly provides reciprocating movement to a hose guide to uniformly and smoothly wrap hose onto said spool assembly to provide a compact storage configuration.

* * * * *